US010765243B1

(12) United States Patent
Lee

(10) Patent No.: US 10,765,243 B1
(45) Date of Patent: Sep. 8, 2020

(54) REUSABLE STRAW KIT

(71) Applicant: Te-Hsin Lee, Toufen (TW)

(72) Inventor: Te-Hsin Lee, Toufen (TW)

( * ) Notice: Subject to any disclaimer, the term of this patent is extended or adjusted under 35 U.S.C. 154(b) by 0 days.

(21) Appl. No.: 16/558,349

(22) Filed: Sep. 3, 2019

(51) Int. Cl.
*A47G 21/18* (2006.01)

(52) U.S. Cl.
CPC ..... *A47G 21/18* (2013.01)

(58) Field of Classification Search
CPC ..... A47G 21/186; A47G 21/18
USPC ..... 239/16, 24, 33; 138/129, 118
See application file for complete search history.

(56) References Cited

U.S. PATENT DOCUMENTS 1,944,970 A * 1/1934 Dieffenbach ..... B31C 3/00 156/195
1,996,066 A * 4/1935 Garling ..... B31C 3/00 138/144
2,084,673 A * 6/1937 Dieffenbach ..... A47G 21/18 138/144
3,270,778 A * 9/1966 Foll ..... B31C 3/00 138/144
3,517,702 A * 6/1970 Trimble ..... H02G 3/0481 138/128
4,865,890 A * 9/1989 Erlichman ..... B29C 61/10 428/35.1
4,944,976 A * 7/1990 Plummer, III ..... H02G 3/0481 138/110
8,312,875 B2 * 11/2012 Frater ..... A61M 16/08 128/200.24
2018/0160831 A1 * 6/2018 Yoo ..... A47G 21/18
2020/0063349 A1 * 2/2020 Parker ..... D21H 13/06

* cited by examiner

*Primary Examiner* — Justin M Jonaitis

(57) ABSTRACT

A reusable straw kit includes an elastic sheet and a fastener. The elastic sheet has a first side, a second side, a third side, a fourth side, a fifth side, and a sixth side. The second side is substantially parallel to the first side. The third side extends from a bottom of the first side, at a first predetermined angle to the first side. The fourth side extends from a bottom of the second side to join with and at a second predetermined angle to the third side. The fifth side extends from a top of the first side and substantially parallel to the fourth side. The sixth side extends from a top of the second side to join with and at a third predetermined angle to the fifth side. As such, s straw can be formed by rolling the elastic sheet in a direction perpendicular to the third side.

10 Claims, 9 Drawing Sheets

REUSABLE STRAW KIT

TECHNICAL FIELD OF THE INVENTION

The present invention relates to a kitchen utensil and, more particular, to a reusable straw kit that includes an elastic sheet.

DESCRIPTION OF THE PRIOR ART

In line with the trend of global environmental awareness, some straw manufacturers have proposed bamboo straws, straw-made straws, sugarcane straws, paper straws, seaweed straws (edible), stainless-steel straws, glass straws and so on, to replace plastic straws.

However, for those alternative products, there are some problems to overcome. For example, straws made from plants consume a lot of energy in the manufacturing, such as cleaning, sterilizing, removing eggs, removing odors, and the like. Edible seaweed straws are expensive and are difficult to push to the market. Stainless-steel straws and glass straws are difficult to clean without using special tools. Also, due to high cost of stainless steel, large stainless-steel straws have not been manufactured yet to be sold on the market. Due to fragility, glass straws are not suitable to be manufactured in large diameters; besides, large glass straws are inconvenient to carry.

Thus, there is a need to provide a straw that can overcome the aforementioned problems.

SUMMARY OF THE INVENTION

One object of the present invention is to provide a reusable straw kit, which includes an elastic sheet, which can be rolled into a straw easily for drinking beverages, and can be cleaned thoroughly without using a special tool.

The reusable straw kit is advantageous in that: the elastic sheet made of silicone can resist high and low temperatures; the elastic sheet is soft in texture so that it does not cause damages; the elastic sheet ensures a straw rolled therefrom to be watertight; the straw formed by the elastic sheet can be disassembled and unfolded to be cleaned thoroughly without using special tools; the elastic sheet can be marked with lines to facilitate forming a straw with a desired diameter; the elastic sheet can be rolled along its lengthwise direction to become a short tube, which in turn can be received in a storage cylinder for hygiene and easy carrying; the storage cylinder can be provided with a cutting blade to facilitate cutting a sealing film of a cup; the elastic sheet can cooperate with various types of fasteners to keep a straw rolled therefrom in shape.

The reusable straw kit generally comprises an elastic sheet and a fastener. The elastic sheet has a first side, a second side, a third side, a fourth side, a fifth side, and a sixth side. The second side is substantially parallel to the first side. The third side extends from a bottom of the first side, at a first predetermined angle to the first side. The fourth side extends from a bottom of the second side to join with and at a second predetermined angle to the third side. The fifth side extends from a top of the first side and substantially parallel to the fourth side. The sixth side extends from a top of the second side to join with and at a third predetermined angle to the fifth side. As such, the elastic sheet can be rolled from the third side in a direction perpendicular to the third side to form a tube, and the fastener can be releasably attached at one end of the tube to keep the tube in shape, thereby forming a drinking straw.

According to one aspect of the present invention, the fastener can be a press stud composed of first and second parts, wherein the first part is attached at an inner surface of the elastic sheet, near the sixth side, while the second part is attached at an outer surface of the elastic sheet, near the fifth side and at a predetermined distance from the first part.

According to another aspect of the present invention, the fastener can be a Velcro device composed of first and second parts, wherein the first part is attached at an inner surface of the elastic sheet, near the sixth side, while the second part is attached at an outer surface of the elastic sheet, near the fifth side and at a predetermined distance from the first part.

According to a further aspect of the present invention, the fastener can be in the form of a ring or band.

The reusable straw kit may further comprise a storage cylinder for accommodating the elastic sheet that has been rolled into a short tube, wherein the storage cylinder may be provided with a blade to facilitate cutting a sealing film of a cup.

According to a further still aspect of the present invention, one or more lines parallel to the third side and each corresponding to a straw's diameter can be marked on an inner surface of the elastic sheet. In use, the third side can be aligned with one of the lines to facilitate the elastic sheet being rolled into a straw of a desired diameter.

Other objects, advantages, and novel features of the present invention will become more apparent from the following detailed description when taken in conjunction with the accompanying drawings.

DETAILED DESCRIPTION OF THE PREFERRED EMBODIMENTS

To achieve the above object and understand the technical solution used in the present invention, preferred embodiments are illustrated in the following paragraphs with reference to the accompanying drawings.

Figure 1:
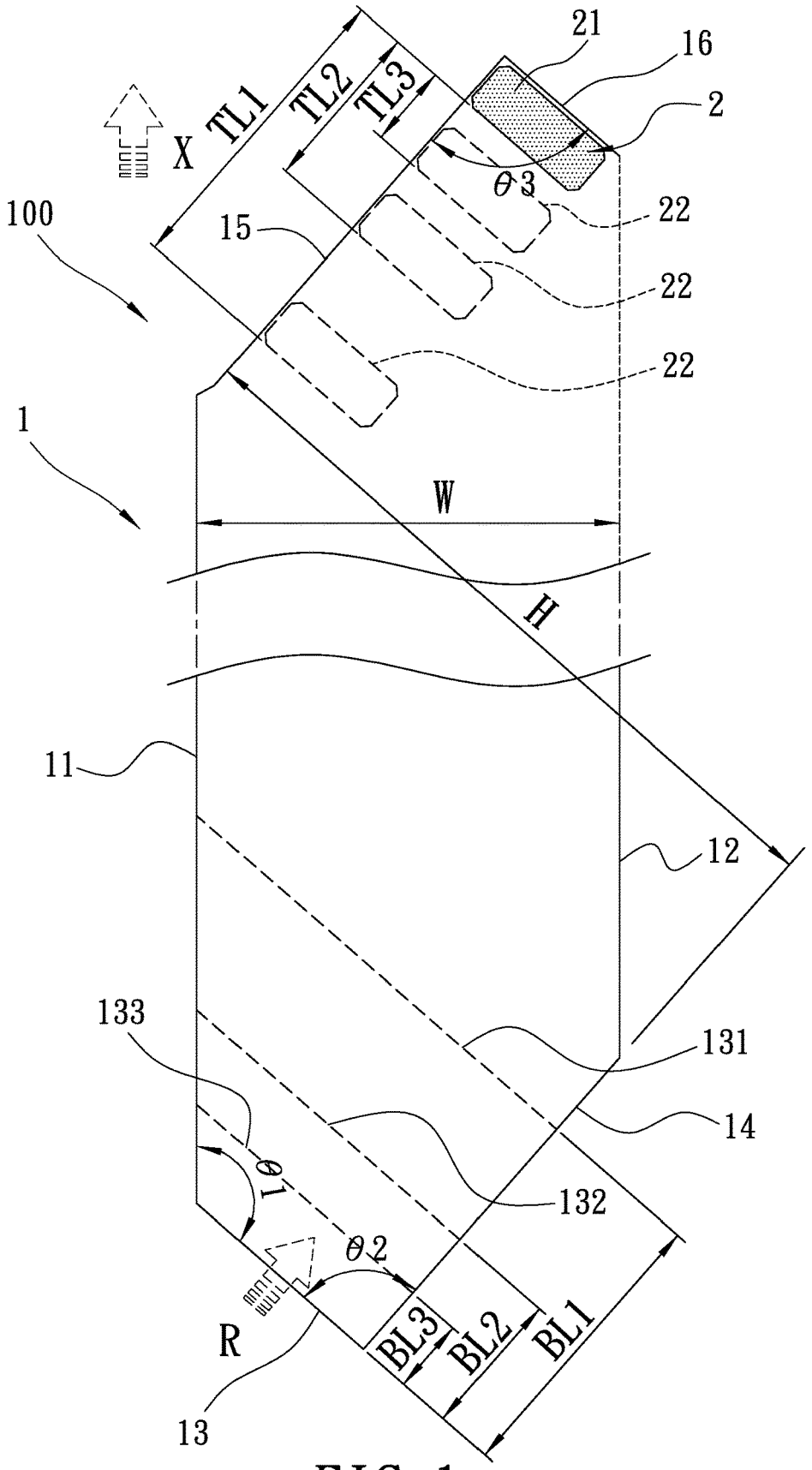
FIG. 1 shows a schematic view of one embodiment of an elastic sheet being used to make a straw according to the present invention, wherein the elastic sheet is provided thereon with a Velcro device.

Referring to FIG. 1, a reusable straw kit 100 according to one embodiment of the present invention is shown, which generally comprises an elastic sheet or film 1, and a fastener 2.

As shown, the elastic sheet 1 has a first side 11, a second side 12, a third side 13, a fourth side 14, a fifth side 15, and a sixth side 16. The first side 11 extends in a lengthwise or longitudinal direction (X). The second side 12 is substantially parallel to the first side 11. The third side 13 extends from a bottom of the first side 11, at a first predetermined angle (Θ1) to the first side 11. The fourth side 14 extends from a bottom of the second side 12 to join with and at a second predetermined angle (Θ2) to the third side 13. The fifth side 15 extends from a top of the first side 11 and substantially parallel to the fourth side 14. The sixth side 16 extends from a top of the second side 12 to join with and at a third predetermined angle (Θ3) to the fifth side. Preferably, the first predetermined angle (Θ1) ranges from 110 to 160 degrees; the second predetermined angle (Θ2) ranges from 65 to 115 degrees; the third predetermined angle (Θ3) ranges from 65 to 115 degrees. More preferably, the first predetermined angle (Θ1) ranges from 130 to 140 degrees; the second predetermined angle (Θ2) ranges from 85 to 95 degrees; the third predetermined angle (Θ3) ranges from 85 to 95 degrees. In use, the elastic sheet 1 can be rolled from the third side 13 in a direction (R) perpendicular to the third side 13. The elastic sheet 1 can be overlapped in part to form a tube for sucking a liquid, which can prevent the liquid from leaking out due to the overlapped portions. The extent of overlap in the tube depends on the first predetermined angle (Θ1). The fastener 2, which can be used to keep the tube in shape, will be illustrated later.

Figure 2:
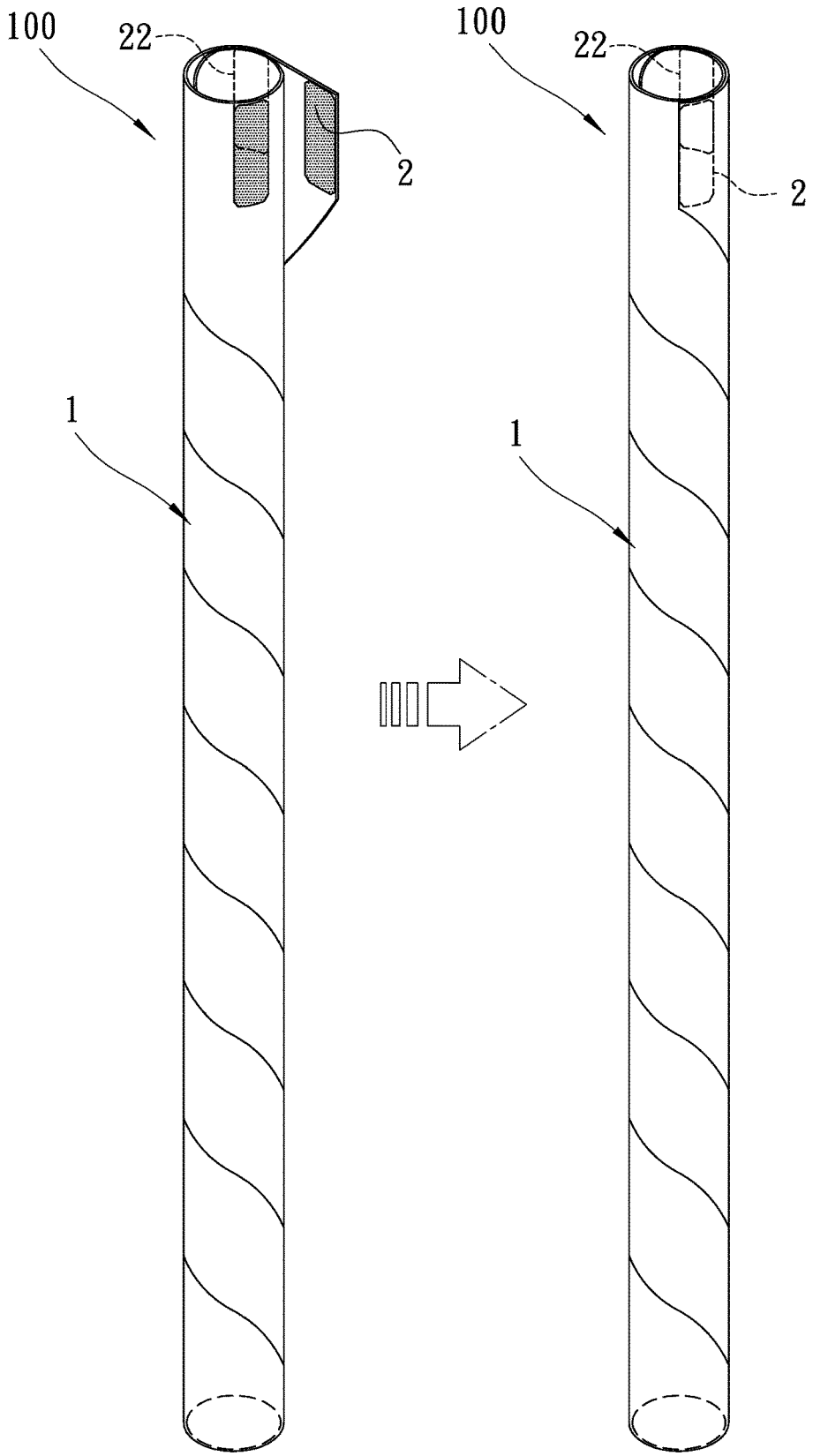
FIG. 2 shows a schematic view of a middle straw made from the elastic sheet shown in FIG. 1.
Figure 3:
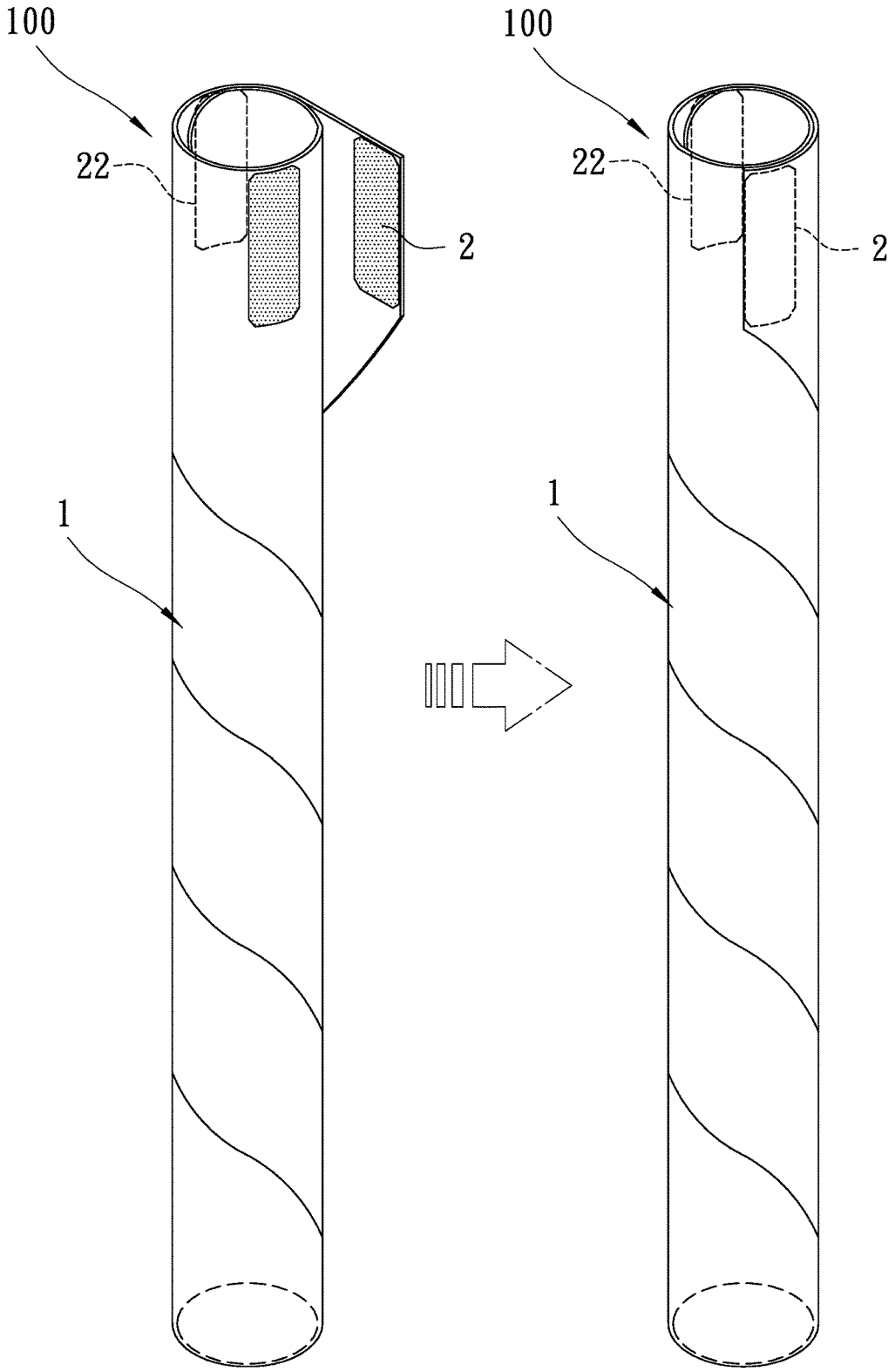
FIG. 3 shows a schematic view of a large straw made from the elastic sheet shown in FIG. 1.
Figure 4:
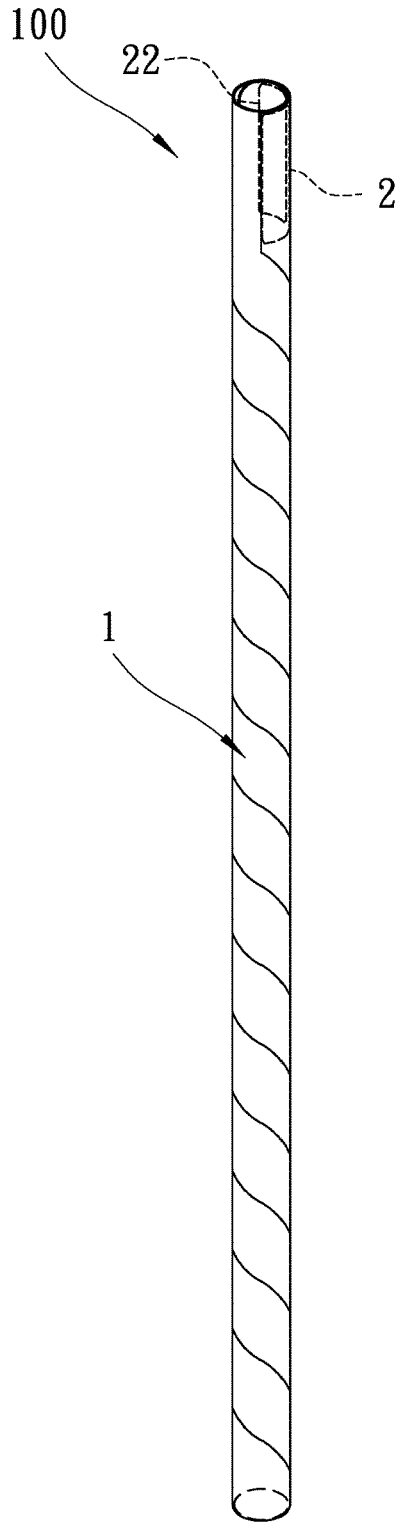
FIG. 4 shows a schematic view of a small straw made from the elastic sheet shown in FIG. 1.

Preferably, one or more lines parallel to the third side 13, each corresponding to a diameter of a straw desired to make, are marked on an inner surface of an elastic sheet. For example, as shown in FIG. 1, there are three lines 131, 132, 133 marked on the elastic sheet 1, which are away from the third side 13 respectively at distances (BL1, BL2, BL3). To form a large straw (see FIG. 3), a user may align the third side 13 with line 131 and then roll the sheet in the direction (R) towards the sixth side 16. To form a middle straw (see FIG. 2), a user may align the third side 13 with line 132 and then roll the sheet in the direction (R) towards the sixth side 16. To form a small straw (see FIG. 4), a user may align the third side 13 with line 133 and then roll the sheet in the direction (R) towards the sixth side 16. It is noticed that the small straw can also be used as a chopstick.

Figure 9:
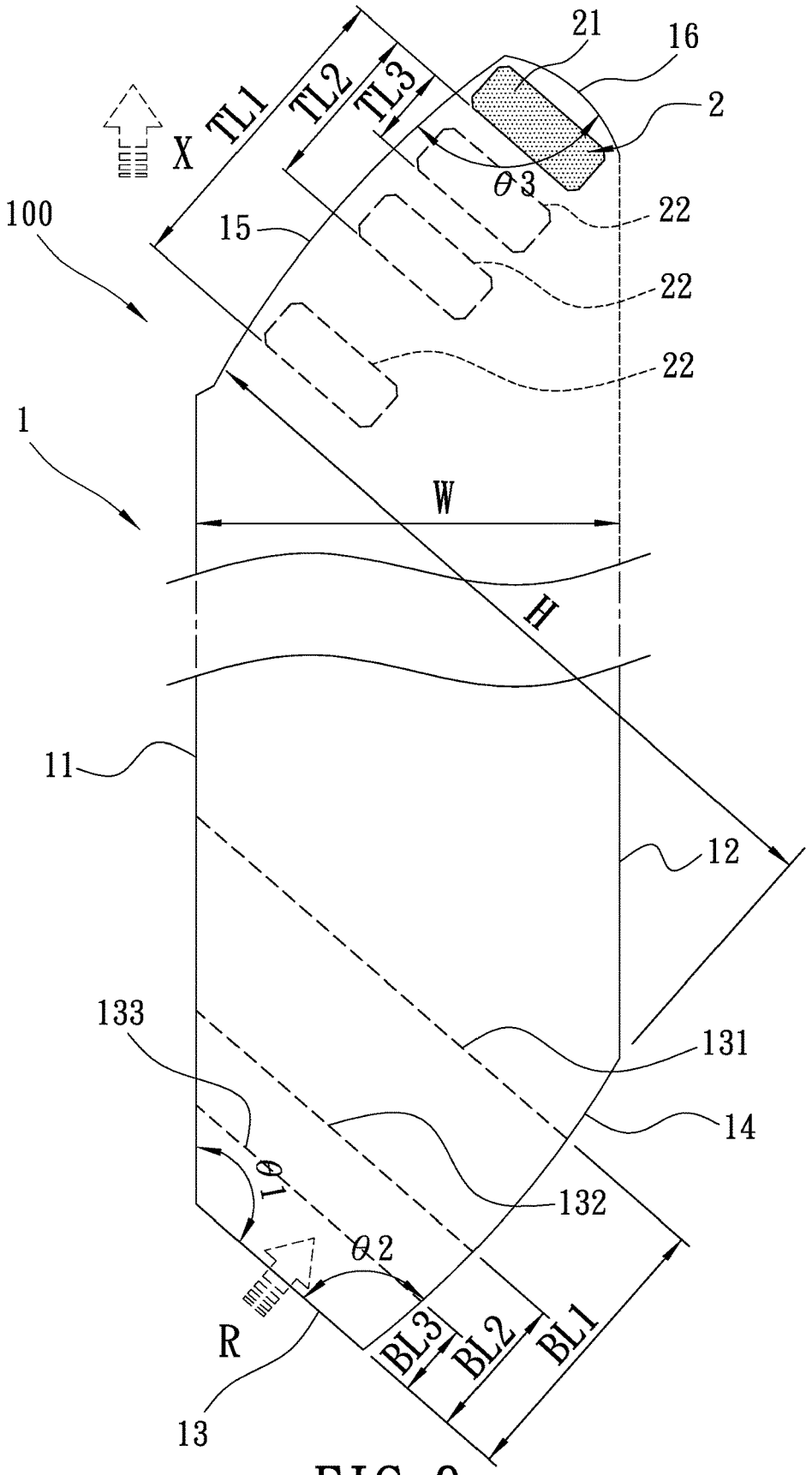
FIG. 9 shows a schematic view of another embodiment of the elastic sheet, wherein the elastic sheet is provided thereon with a Velcro device, and includes curved sides.

FIG. 9 shows another embodiment of the elastic sheet, wherein the fourth side 14, the fifth side 15, and the sixth side 16 are configured as curved sides instead of straight sides shown in FIG. 1.

The elastic sheet or film 1 can be made of silicone or other non-toxic, elastic materials that are environmentally friendly. A suitable thickness and/or hardness required for an elastic sheet or film for making a straw can be obtained according to the characteristics of a beverage that the straw will suck.

The fastener 2 can be in the form of a Velcro device, which is generally composed of a first part and at least one second part, wherein the first part can be a hooks portion while the second part can be a loops portion; alternatively, the first part can be a loops portion while the second part can be a hooks portion. As shown in FIG. 1, the Velcro device is composed of a first part 21 and three second parts 22, wherein the first part 21 is attached at an inner surface of the elastic sheet 1, near the sixth side 16, while the second parts 22 are attached at an outer surface of the elastic sheet 1, near the fifth side 15. More specifically, the three second parts 22 are located at distances (TL1, TL2, TL3) from the first part 21, wherein distance of TL1 is approximately equal to that of BL1; distance of TL2 is approximately equal to that of BL2, distance of TL3 is approximately equal to that of BL3. For a large straw (see FIG. 3), the first part 21 can be engaged with the second part 22 that is spaced at the distance TL1 from the first part 21. For a middle straw (see FIG. 2), the first part 21 can be engaged with the second part 22 that is spaced at the distance TL2 from the first part 21. For a small straw (see FIG. 4), the first part 21 can be engaged with the second part 22 that is spaced at the distance TL3 from the first part 21.

Alternatively, the fastener 2 can be in the form of a press stud, which is generally composed of a first part and at least one second part, wherein the first part can be a male part while the second part can be a female part; alternatively, the first part can be a female part while the second part can be a male part. The first part can be attached at the inner surface of the elastic sheet 1, near the sixth side 16, while the second part can be attached at the outer surface of the elastic sheet 1, near the fifth side 15. Alternatively, the fastener 2 can be in the form of a fastening device using suction cups or magnetic disks.

Figure 5:
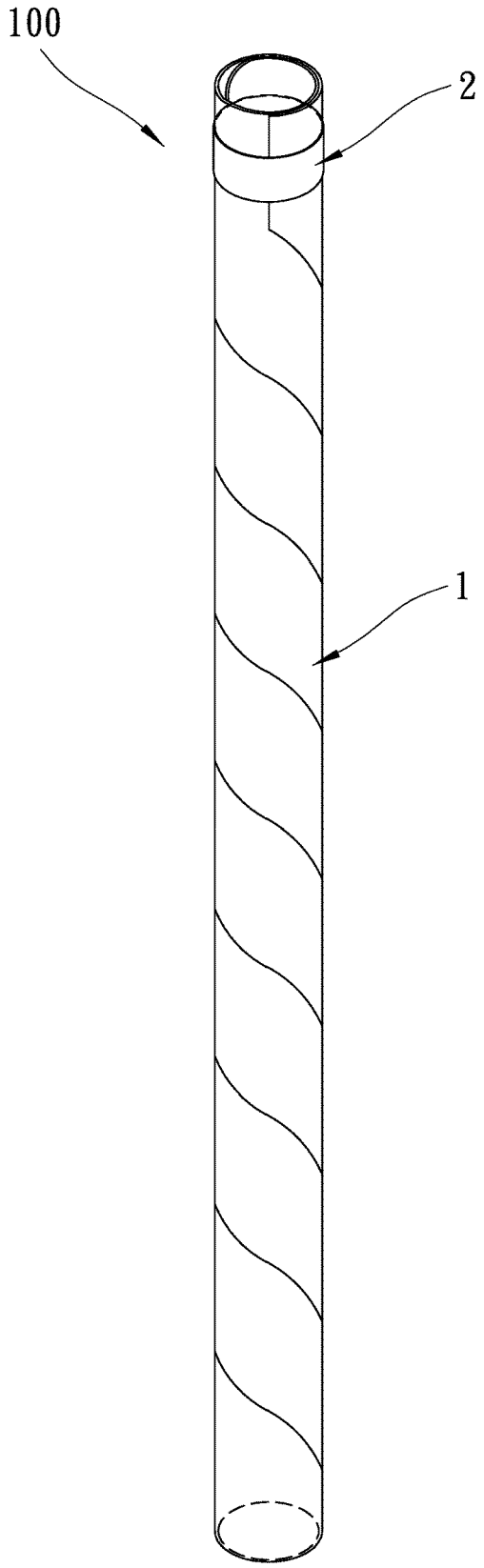
FIG. 5 shows a schematic view of a middle straw made from an elastic sheet, wherein a middle ring is used instead of the Velcro device shown in FIG. 1.
Figure 6:
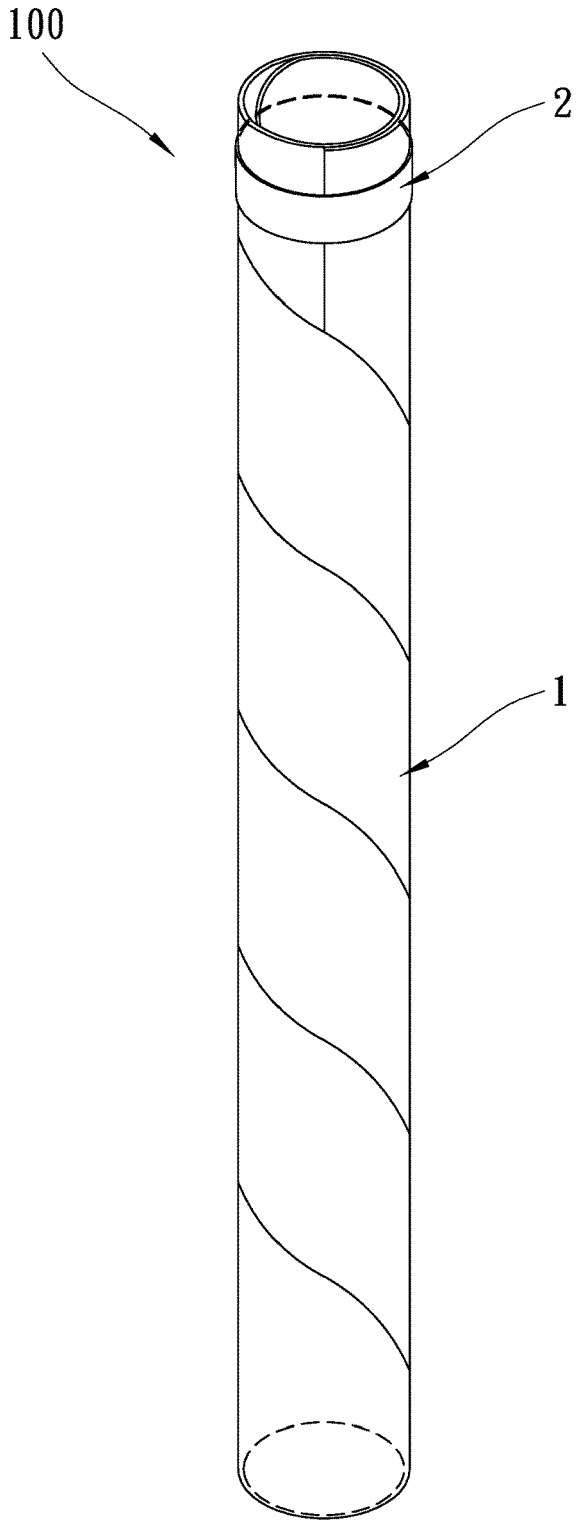
FIG. 6 shows a schematic view of a large straw made from an elastic sheet, wherein a large ring is used instead of the Velcro device shown in FIG. 1.

Alternatively, as shown in FIGS. 5 and 6, the fastener 2 can be a ring or band, which can be fitted around an end portion of the straw formed by rolling the elastic sheet 1. FIG. 5 shows a middle straw, which requires a middle ring. FIG. 6 shows a large straw, which requires a large ring.

While the straw is not in use, the fastener 2 can be easily unlocked or detached from the elastic sheet 1 to allow the elastic sheet 1 to be unfolded to its original state, which facilitates a cleaning operation. Furthermore, as shown in FIG. 7, the elastic sheet 1 can be rolled in its lengthwise or longitudinal direction (X) to become a short tube, which has a width of W (i.e., the distance between the first side 11 and the second side 12 as show in FIG. 1), which is less than the height (H) of the straw formed by the elastic sheet 1.

Figure 7:
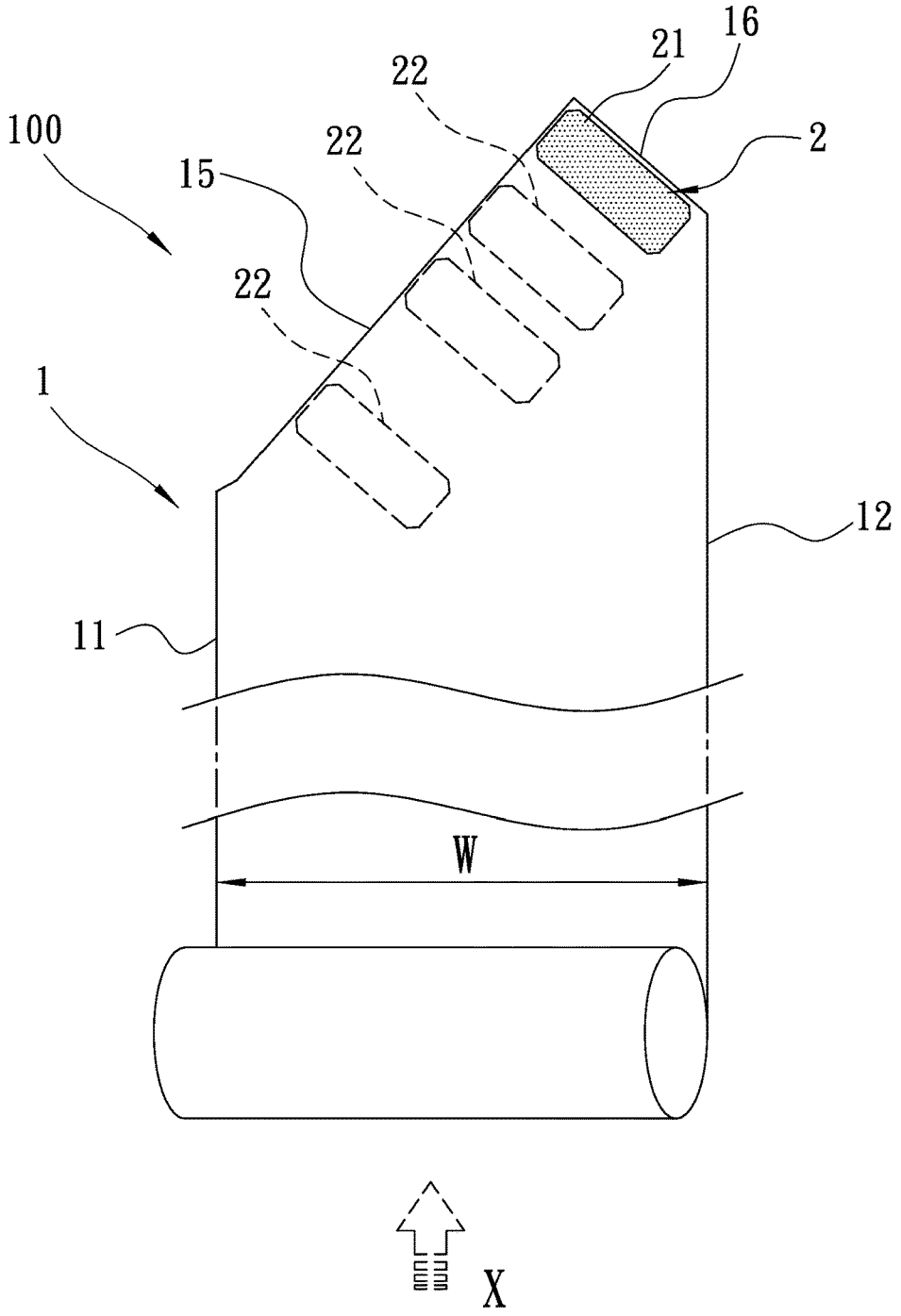
FIG. 7 shows a schematic view of an elastic sheet being rolled in its lengthwise direction into a short tube to facilitate storage.
Figure 8:
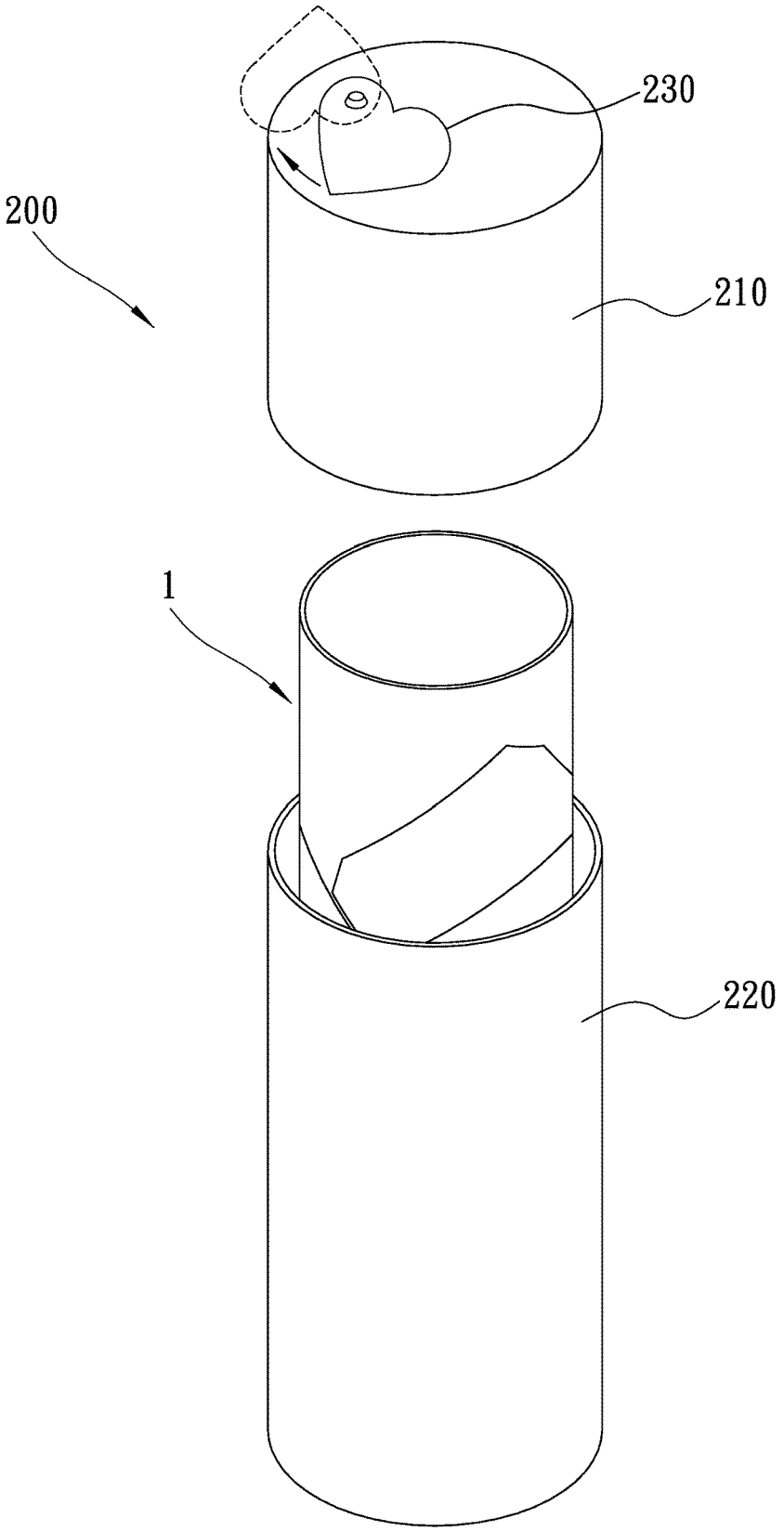
FIG. 8 shows a schematic view of a storage cylinder for accommodating an elastic sheet that has been rolled into a short tube.

Referring to FIG. 8, the reusable straw kit of the present invention may further comprise a storage cylinder 200 to accommodate the elastic sheet 1 that has been rolled into a short tube as shown in FIG. 7 to facilitate storage. The storage cylinder 200 includes a container body 220 and a cap 210. In addition, the storage cylinder 200 can be provided on top of the cap 210 with a cutting blade 230, which can be used to cut a plastic sealing film of a cup.

As a summary, the reusable straw kit of the present invention has several advantages. Firstly, the elastic sheet made of silicone is non-toxic and can resist high and low temperatures. Secondly, the elastic sheet 1 is soft in texture so that it does not cause damages. Thirdly, the elastic sheet ensures a drinking straw rolled therefrom to be watertight. Fourthly, the straw formed by the elastic sheet can be disassembled and unfolded easily and can be cleaned thoroughly without using special cleaning tools. Fifthly, the elastic sheet is marked with lines to facilitate forming a straw with a desired diameter. Sixthly, the elastic sheet can be rolled along its lengthwise direction to become a short tube, which in turn can be received in a storage cylinder for hygiene and easy carrying. Seventhly, the storage cylinder can be provided thereon with a blade to facilitate cutting a sealing film of a cup. Eighthly, the elastic sheet can cooperate with various types of fasteners to keep the straw rolled therefrom in shape.

Although the present invention has been described with a certain degree of particularity, it is understood that the present disclosure is made by way of example only and the combination and arrangement of parts may be resorted to without departing from the scope of the invention hereinafter claimed.

What is claimed is:

1. A reusable straw kit, comprising:

an elastic sheet having a first side, a second side, a third side, a fourth side, a fifth side, and a sixth side, wherein the second side is substantially parallel to the first side; the third side extends from a bottom of the first side, at a first predetermined angle to the first side; the fourth side extends from a bottom of the second side to join with and at a second predetermined angle to the third side, the fifth side extends from a top of the first side and substantially parallel to the fourth side; the sixth side extends from a top of the second side to join with and at a third predetermined angle to the fifth side; and a fastener;

whereby the elastic sheet is capable of being rolled from the third side in a direction perpendicular to the third side to form a tube, and the fastener is capable of being releasably attached to one end portion of the tube for keeping the tube in shape, thereby forming a drinking straw.

2. The reusable straw kit of claim 1, wherein the first predetermined angle is greater than 110 degrees and less than 160 degrees; the second predetermined angle is greater than 65 degrees and less than 115 degrees; the third predetermined angle is greater than 65 degrees and less than 115 degrees.

3. The reusable straw kit of claim 2, wherein the first predetermined angle is greater than 130 degrees and less than 140 degrees; the second predetermined angle is greater than 85 degrees and less than 95 degrees; the third predetermined angle is greater than 85 degrees and less than 95 degrees.

4. The reusable straw kit of claim 1, wherein the fourth side, the fifth side, or the sixth side is curved.

5. The reusable straw kit of claim 1, wherein the fastener is a press stud composed of a first part and at least one second part, the first part being attached at an inner surface of the elastic sheet, near the sixth side, while the second part being attached at an outer surface of the elastic sheet, near the fifth side and at a predetermined distance from the first part.

6. The reusable straw kit of claim 1, wherein the fastener is a Velcro device composed of a first part and at least one second part, the first part being attached at an inner surface of the elastic sheet, near the sixth side, while the second part being attached at an outer surface of the elastic sheet, near the fifth side and at a predetermined distance from the first part.

7. The reusable straw kit of claim 1, wherein the fastener is a ring or band capable of fitting around the end portion of the tube rolled from the elastic sheet.

8. The reusable straw kit of claim 1, wherein the elastic sheet is made of silicone.

9. The reusable straw kit of claim 1, further comprising a storage cylinder for accommodating a short tube that is obtained by rolling the elastic sheet along its lengthwise direction, the storage cylinder provided with a blade for cutting a cup.

10. The reusable straw kit of claim 1, wherein one or more lines parallel to the third side and each corresponding to a straw's diameter are marked on an inner surface of the elastic sheet, so that the elastic sheet is easily rolled into a straw of a desired diameter by aligning the third side with one of the lines.

* * * * *